US008668436B2

(12) United States Patent
Oishi

(10) Patent No.: US 8,668,436 B2
(45) Date of Patent: Mar. 11, 2014

(54) TURBOMOLECULAR PUMP

(75) Inventor: Kouta Oishi, Kyoto (JP)

(73) Assignee: Shimadzu Corporation, Kyoto-Shi (JP)

( * ) Notice: Subject to any disclaimer, the term of this patent is extended or adjusted under 35 U.S.C. 154(b) by 797 days.

(21) Appl. No.: 12/867,232

(22) PCT Filed: Feb. 15, 2008

(86) PCT No.: PCT/JP2008/052540
§ 371 (c)(1),
(2), (4) Date: Nov. 4, 2010

(87) PCT Pub. No.: WO2009/101699
PCT Pub. Date: Aug. 20, 2009

(65) Prior Publication Data

US 2011/0064562 A1 Mar. 17, 2011

(51) Int. Cl.
*F04D 25/16* (2006.01)

(52) U.S. Cl.
USPC ..... 415/90; 416/223 A; 417/423.4

(58) Field of Classification Search
USPC ..... 417/423.4; 415/90
See application file for complete search history.

(56) References Cited

U.S. PATENT DOCUMENTS

| | | | | |
|---|---|---|---|---|
| 3,826,588 | A * | 7/1974 | Frank | 415/90 |
| 5,033,936 | A * | 7/1991 | Shinojima | 415/90 |
| 5,052,887 | A * | 10/1991 | Novikov et al. | 415/90 |
| 6,499,942 | B1 | 12/2002 | Nonaka et al. | 415/90 |

FOREIGN PATENT DOCUMENTS

| | | | |
|---|---|---|---|
| EP | 0829645 | A2 | 3/1998 |
| EP | 1004775 | A2 | 5/2000 |
| JP | 02-061387 | | 3/1990 |
| JP | 10-089284 | | 4/1998 |
| JP | 10089284 | A | 4/1998 |
| JP | 2000-110771 | | 4/2000 |
| JP | 2000110771 | A | 4/2000 |
| JP | 2000-161285 | | 6/2000 |
| JP | 2000161285 | A | 6/2000 |
| JP | 2003-003987 | | 1/2003 |
| JP | 2003003987 | A | 1/2003 |

OTHER PUBLICATIONS

Translation of the International Preliminary Report on Patentability and Written Opinion of the International Authority.

* cited by examiner

*Primary Examiner* — Nathaniel Wiehe
*Assistant Examiner* — Justin Seabe
(74) *Attorney, Agent, or Firm* — Bingham McCutchen LLP

(57) ABSTRACT

A turbomolecular pump has multiple stages of alternately arranged rotors and stators. Each of the rotors has blades radially extending from a rotating body. Each of the stators has blades radially extending toward the rotating shaft of the rotating body. The blades provided on at least either of a rotor and a stator are formed in a twisted shape having a blade angle set by an expression in which the radial distance from the rotating shaft is a variable. The expression of the blade angle is composed of a first expression which provides the optimum angle of each blade on the outer side of a predetermined radius of the blade and also composed of a second expression which provides the blade angle suppressing, on the inner side of the predetermined radius, reverse flow of gas molecules.

5 Claims, 7 Drawing Sheets

(a)

(b)

(a)

(b)

TURBOMOLECULAR PUMP

CROSS-REFERENCE TO THE RELATED APPLICATIONS

This application is a national stage of international application No. PCT/JP2008/052540, filed on Feb. 15, 2008, the entire contents of which are incorporated herein by reference.

TECHNICAL FIELD

The present invention relates to a turbomolecular pump.

BACKGROUND ART

A turbomolecular pump uses the operation of turbine blades that combine rotors and stators to create a vacuum by evacuation. Turbine blades are radially formed about a rotational shaft so that the circumferential velocity is different between the base portion of the blade and the tip portion of the blade. Because of this, the design is optimized so that the performance as defined by the blade angle and the distance between the blades at an intermediate point between the blade base and the blade tip achieves the target performance.

However, if turbine blades are constructed of flat plates as previously done, at points located more distally than an intermediate point, the increase in the aperture rate becomes greater than the increase in the circumferential velocity. This increases the effects of reverse flow as compared to the effects at an intermediate point, undermining the optimum design. With the present specification, the rate by which the opposite side is visible when looking down the axial direction of the turbine blade is referred to as the aperture rate.

Because of this, twisted blades have been proposed where the blade angle of the turbine blade gradually decreases from the blade base towards the blade tip so as to prevent the increase in the aperture rate at the outer blades (see for example Patent Literature 1).

Patent Literature 1: Unexamined Patent Application Publication 02-61387

DISCLOSURE OF THE INVENTION

Problems to Be Solved by the Invention

However, with the afore-described twisted blade, because the blade angle is set to be optimized in the region from the intermediate area of the blade to the outer tip of the blade, in the case of a turbine blade wherein the blade angle is changed so that the blade angle becomes gradually smaller from the blade base to the blade tip, the blade angle at the blade base portion where the circumferential velocity is small becomes too large, which increases the effects of reverse flow on exhaust performance. In particular, in the case where the exhaust is accompanied by a high flow rate, as molecular flow approaches an intermediate flow, the drop in exhaust performance caused by reverse flow becomes significant.

Means for Solving the Problems

The turbomolecular pump according to the present invention includes multiple stages of alternately arranged rotors including a plurality of blades radially extending from a rotating body and stators including a plurality of blades radially extending toward the rotating shaft of said rotating body, wherein the blades provided on at least either of the rotor or the stator are formed as twisted blades having a blade angle of the blades set by an equation in which the radius from the rotational shaft is a variable, and the equation of the blade angle includes a first equation which provides the optimum angle of each blade located outside of a predetermined radius and a second equation which provides the blade angle that suppresses reverse flow of gas molecules inside the predetermined radius.

With the turbomolecular pump according to the present invention, the blade angle $\alpha$ in the first equation satisfies the condition "$\alpha out \leq \alpha \leq \alpha b$" and the blade angle $\alpha$ in the second equation satisfies the condition "$\alpha b \geq \alpha \geq \alpha in$" where $\alpha b$ is the blade angle at a predetermined radius, $\alpha in$ is the blade angle at the innermost periphery of said blade and $\alpha out$ is the blade angle at the outermost periphery of said blade. Furthermore, at least either of the equation 1 or equation 2 may consist of a plurality of equations.

Still furthermore, the first equation concerning blade angle $\alpha$ may be set to be "$\alpha = \alpha out + (\alpha b - \alpha out) \cdot (D/Gbout)$" and the second equation may be set to be "$\alpha = \alpha in + (\alpha b - \alpha in) \cdot (G - D)/Gbin$" where $\alpha b$ is the blade angle at a predetermined radius, $\alpha in$ is the blade angle at the innermost periphery of the blade, $\alpha out$ is the blade angle at the outermost periphery of the blade, D is the distance from the outermost periphery of the blade, G is the length of the blade, Gbout is the length from the outermost periphery of the blade to a predetermined radius, and Gbin is the length from the innermost periphery of the blade to a predetermined radius.

In a different mode of a turbomolecular pump according to the present invention, the turbomolecular pump includes multiple stages of alternately arranged rotors including a plurality of blades radially extending from a rotating body and stators including a plurality of blades radially extending toward the rotating shaft of said rotating body, wherein said blade is a twisted blade whose blade angle $\alpha$ satisfies the condition "$\alpha out \leq \alpha \leq \alpha b$" outside of a predetermined radius and satisfies the condition "$\alpha b \geq \alpha \geq \alpha in$" inside of the predetermined radius where $\alpha b$ is the blade angle at the predetermined radius, $\alpha in$ is the blade angle at the innermost periphery of the blade and $\alpha out$ is the blade angle at the outermost periphery of the blade.

With the turbomolecular pump according to the present invention, the blades of the rotor can be formed to satisfy the equation "$\{Sx - (H/\tan \alpha x)\}/2 \geq \{Sy - (H/\tan \alpha y)\}/2$" where Sx and $\alpha x$ respectively represent the inter-blade distance and the blade angle of a blade at any distance from the outermost periphery of a blade, Sy and $\alpha y$ respectively represent the inter-blade distance and the blade angle at a distance less than the aforesaid any distance, and H represents the axial direction height of a blade.

Furthermore, the blades of said rotor may be formed to satisfy the equation "$S = Sout - (Sout - Sin) \cdot (D/G)$" where S represents the inter-blade distance at any distance from the outermost periphery of the blade, Sout represents the inter-blade distance at the outermost periphery of the blade, and Ssin represents the inter-blade distance at the innermost periphery of the blade.

Still furthermore, the inter-blade distance S of the blades of the rotor may be set according to the equation "$S = Sbout - (Sout - Sb) \cdot (D/Gbout)$" outside of a predetermined radius and according to the equation "$S = Sout - (Sb - Sin) \cdot (D - Gbout)/Gbin$" inside of the predetermined radius where S is the inter-blade distance at any distance from the outermost periphery of the blade, Sout is the inter-blade distance at the outermost periphery of the blade, Sin is the inter-blade distance at the innermost periphery of the blade, and Sb is the inter-blade distance at a predetermined radius.

Effects of the Invention

According to the present invention, in a twisted blade, the blade angle of the outer periphery of the blade can be optimized while improving the suppression of the reverse flow of gas molecules at the inner periphery of the blade.

BRIEF DESCRIPTION OF THE FIGURES

FIG. 5(*a*) shows lines L1 through L4 that changes linearly. FIG. 5(*b*) shows line L6 that changes as a curve.

BEST MODE FOR PRACTICING THE INVENTION

The best modes for practicing the present invention are described next with reference to figures.

First Mode

Figure 1:
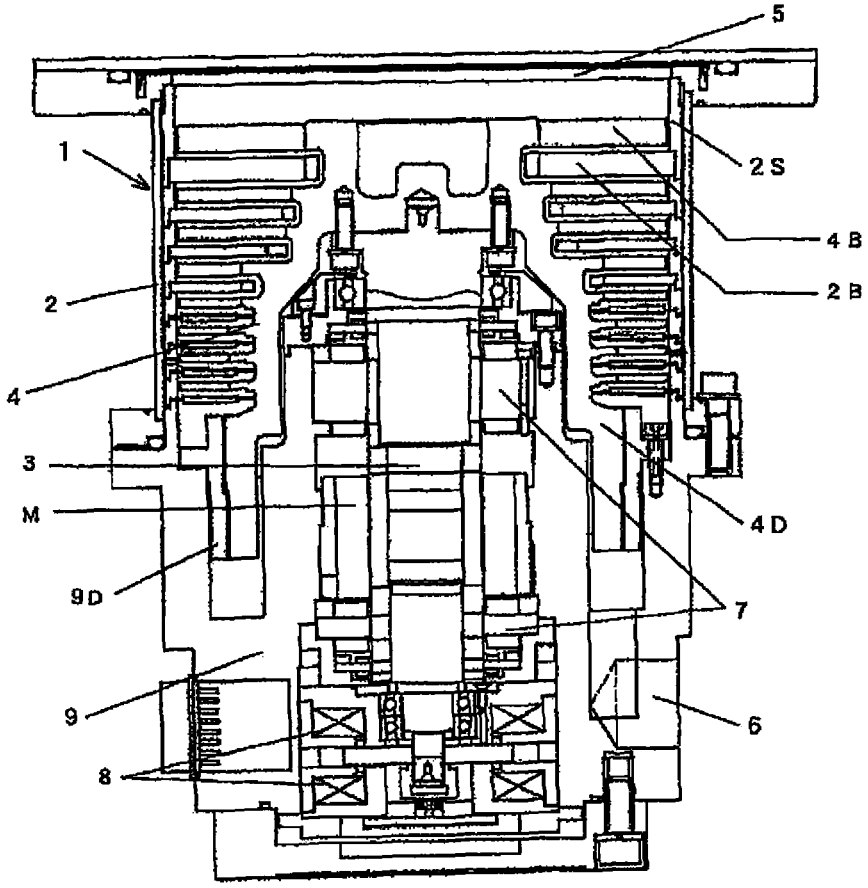
FIG. 1 is a sectional view showing one embodiment of a turbomolecular pump according to the present invention.

FIG. 1 shows a sectional view of the main body of a first mode of a turbomolecular pump according to the present invention. The turbomolecular pump includes the main pump body shown in FIG. 1 and a controller (not illustrated) that supplies power to the main pump body 1 and controls the the rotation of the pump.

Figure 2:
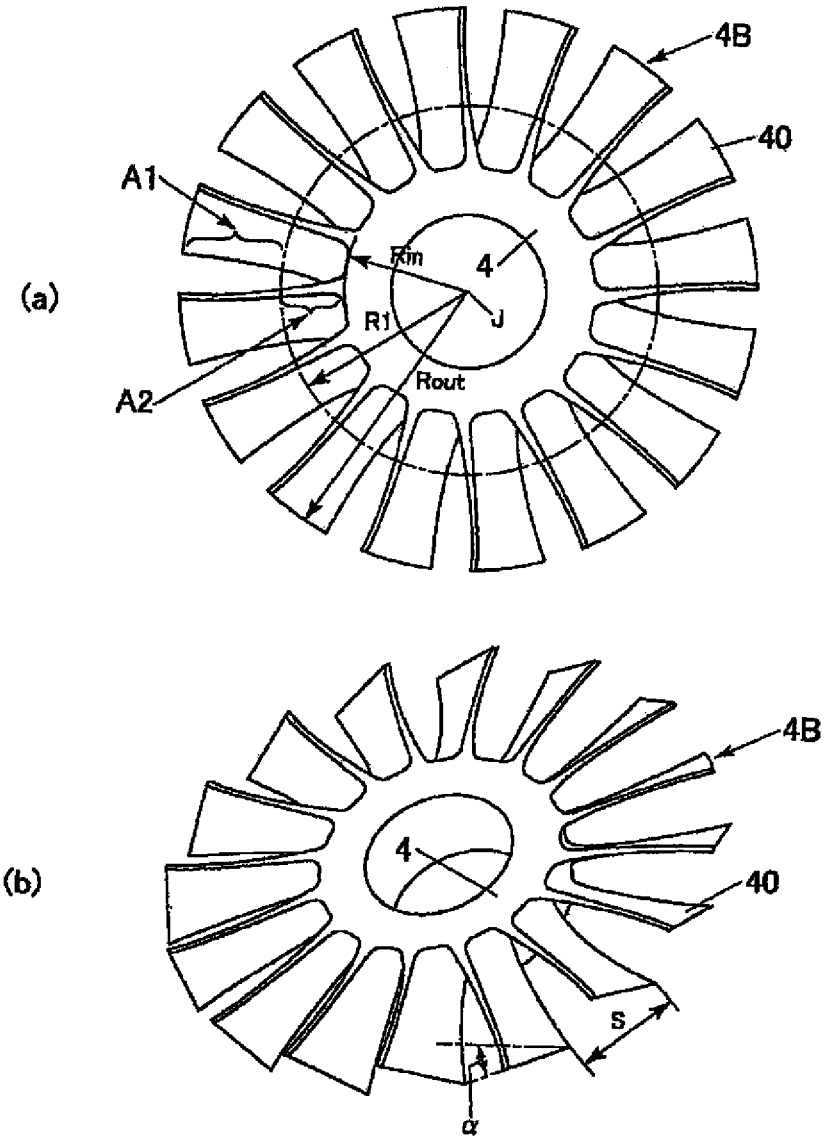
FIG. 2(*a*) shows a plan view of a rotor and (*b*) its perspective view.

Casing 2 of the main pump body 1 includes within it rotor 4 where a plurality of stages of rotors 4B and a rotational cylindrical unit 4D is formed. As FIG. 2 shows, a plurality of blades 40 is formed on rotor 4, and blades 40 that are formed along the entire outer circumference form one stage of rotor 4B. Rotor 4 is bolted to shaft 3. Shaft 3 onto which rotor 4 is secured is supported in a non-contact manner by a pair of top and bottom magnetic radial bearings 7 and magnetic thrust bearings 8 and is driven by motor M. Rotor 4 is made of a metal such as an aluminum alloy that can withstand high-speed rotation.

Figure 3:
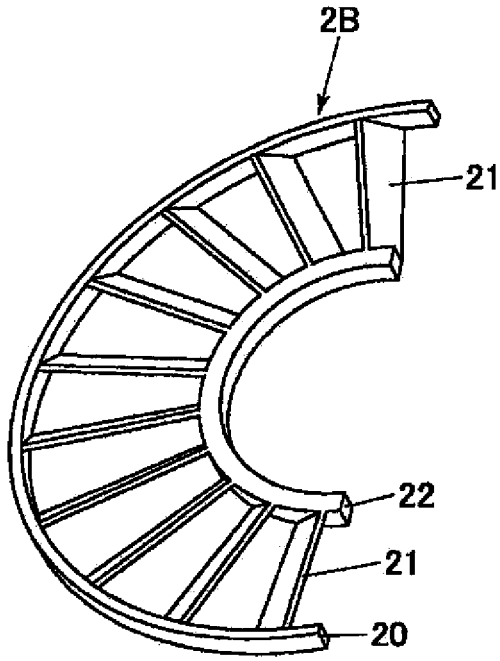
FIG. 3 is a perspective view of the rotor.

A plurality of stages of stators 2B and a fixed cylindrical unit 9D is disposed on the base 9 of the main pump body 1. FIG. 3 is a perspective view of stator 2B. Stator 2B includes an outer frame 20 and an inner frame 22 that are half-ring shaped and a plurality of blades 21. One stage of stators 2B is formed by positioning a pair of said stators 2B so as to surround the rotor 4. A turbine blade unit is constructed from a plurality of stages of rotors 4B and a plurality of stages of stators 2B that are alternately positioned in the axial direction. The plurality of stages of stators 2B is held in a predetermined position inside casing 2 by holding the outer frame 20 from the top and bottom by spacer 2S.

A molecular drag pump unit is constructed by a rotating cylindrical unit 4D and fixed cylindrical unit 9D that are positioned at the downstream side of the turbine blade unit. The rotating cylindrical unit 4D is positioned close to the inner peripheral surface of the fixed cylindrical unit 9D. Spiral grooves are formed on the inner peripheral surface of the fixed cylindrical unit 9D. The spiral grooves of the fixed cylindrical unit 9D and the rotating cylindrical unit 4D which rotates at a high speed create an exhaust action at the molecular drag pump.

A turbomolecular pump that couples the turbine blade unit and the molecular drag pump unit shown in FIG. 1 is referred to as a wide-area type turbomolecular pump. Molecules of gas that flow in through the inlet flange 5 are blown by the turbine blade in the downward direction in the figure and is compressed and expelled toward the downstream side. The compressed Molecules of gas are further compressed by the molecular drag pump unit and are expelled through the exhaust port 6.

In the turbomolecular pump shown in FIG. 1, twisted blades—further described below—are used in the first four stages of rotors 4B and stators 2B counting from the inlet flange. The number of stages of rotors 4B and stators 2B where twisted blades are used is suitably determined based on the required exhaust performance. Before describing the shape of the twisted blades in the present mode, the problems found in previous twisted blades are described first with reference to FIGS. 4 and 5.

Figure 4:
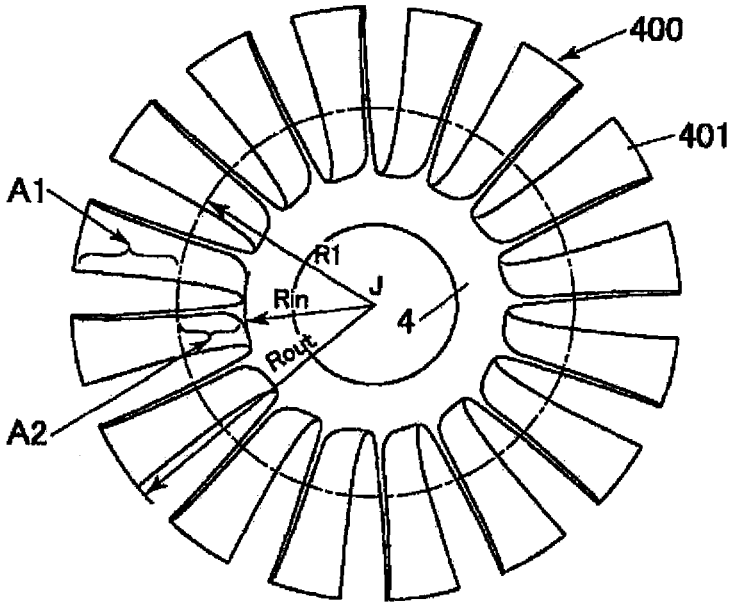
FIG. 4(*a*) shows a plan view of a previous twisted blade and (*b*) its perspective view.
Figure 4:
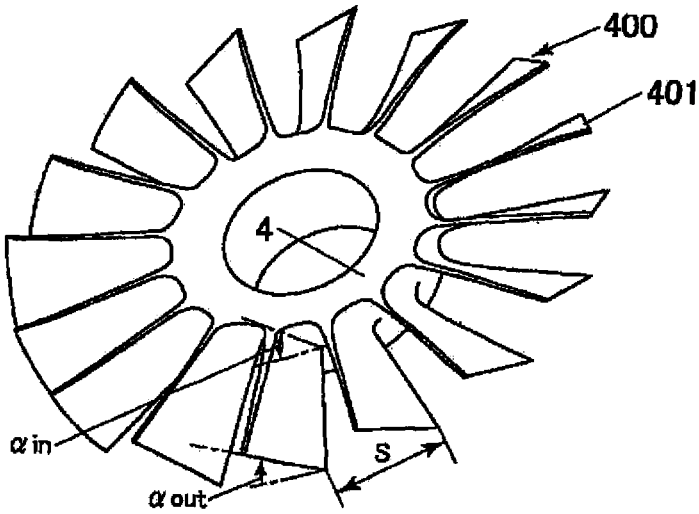

FIG. 4 shows one example of a rotor 400 having twisted blades of a previous kind. FIG. 4(*a*) shows a plan view and (*b*) a perspective view, A plurality of blades 401 required for forming one stage of the rotor 400 is radially formed along the outer periphery of rotor 4 about shaft J of rotor 4. Because of this, the distance S between the blades (hereinafter the "inter-blade distance") becomes increasingly smaller at the inner side. The general practice with a turbomolecular pump is to design the blades so that the exhaust performance is optimized outside of radius R1 (Rout≥R≥R1) where the circumferential velocity is relatively large and higher exhaust performance can be obtained more easily.

With a twisted blade, the blade angle αout at the outermost periphery (blade tip) is set to be smaller than the blade angle αin at the innermost periphery (blade base). With a machining program that is used for cutting and machining the blade 400, one machining equation which uses blade angle α and inter-blade distance S as parameters, is used. It has been a common practice previously to perform the machining using a machining equation where both inter-blade distance S and blade angle α change as a function of radius R. In that case, the blade angle α is set to gradually increase from the blade tip to the blade base. The rotor 400 shown in FIG. 4 has been machined under such a condition.

Figure 5:
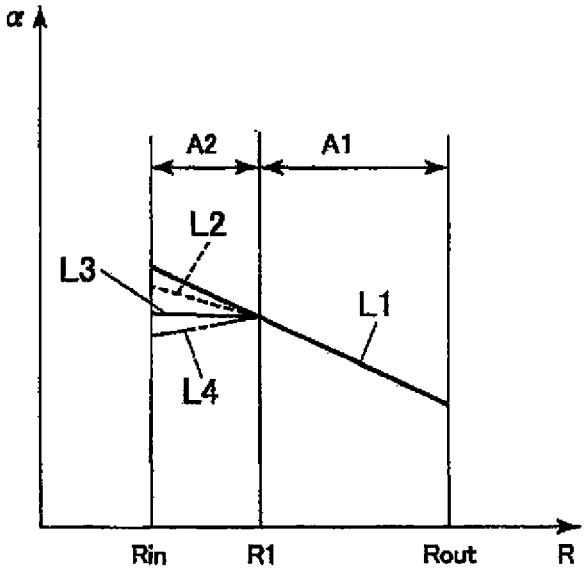
FIG. 5 shows the relationship between radius Rt and blade angle α.
Figure 5:
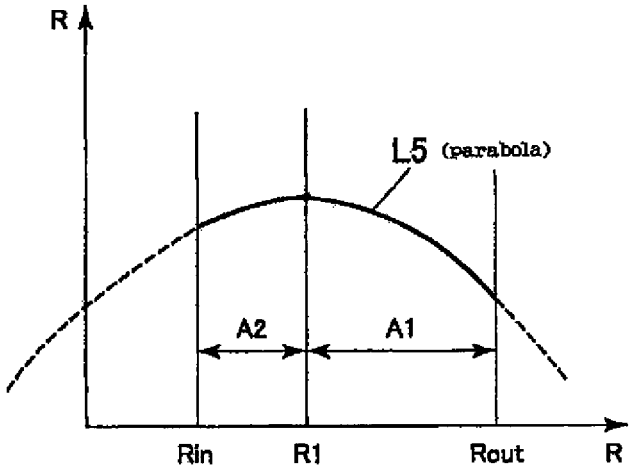

Previously, the relationship between radius Rt and blade angle α was described by a line such as line L1 in FIG. 5(*a*). In this case, blade angle α increases at a constant rate with respect to radius R. The slope of the line L1 is set so that the exhaust performance is optimized in the region A1 extending from the blade tip to somewhere near the middle of the blade. However, since the blade angle α also increases at the same rate in region A2 which lies outside of region A1, a problem is created in that the blade angle α becomes too large in terms of the effects of the reverse flow of the gas.

With the present embodiment, the blade angle α in region A2 which lies inside radius R1 is made to change in accordance with lines L2 through L4 which are different from line L1. Lines L2 through L4 shown in FIG. 5(*a*) can be expressed by the following equations (1) and (2). In equation (2), setting αin>αb produces line L2, setting αin=αb produces line L3, and setting αin<αb produces line L4.

$$\text{(Region } A1\text{)}: \alpha = \alpha\text{out} + (\alpha b - \alpha\text{out}) \cdot (D/Gb\text{out}) \quad (1)$$

$$\text{(Region } A2\text{)}: \alpha = \alpha\text{in} + (\alpha b - \alpha\text{in}) \cdot (G - D)/Gb\text{in} \quad (2)$$

Figure 6:
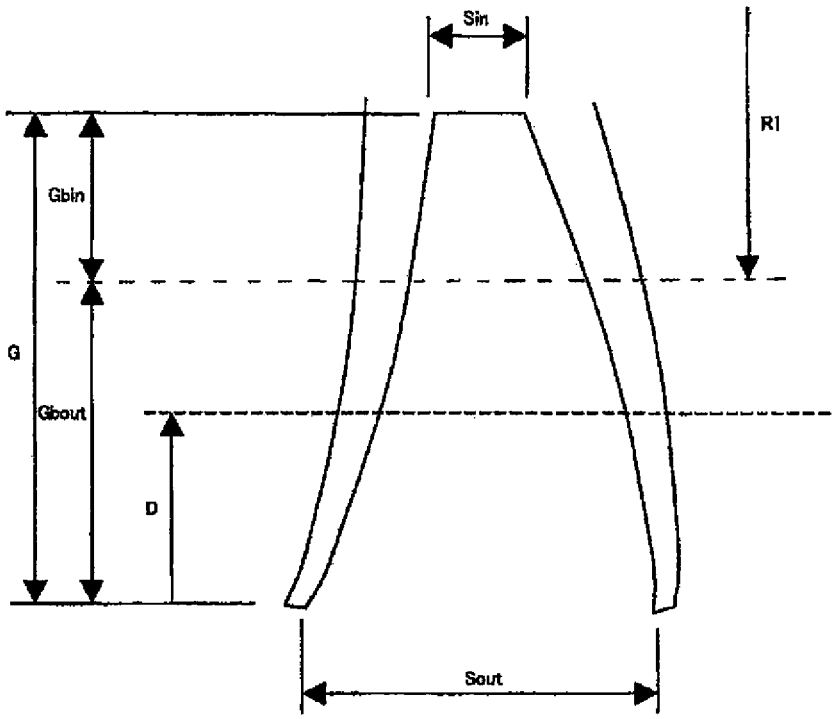
FIG. 6 shows a sectional view where a part of rotor 4B is sectioned in a direction perpendicular to the shaft.

In equations (1) and (2), D, G, Gbout and Gbin refer to the respective dimensions shown in FIG. 6, and αb identifies the blade angle at radius R1. FIG. 6 is a sectional view showing a portion of rotor 4B sectioned in a direction to the shaft. This sectional view has the same shape as the shape of the upper end surface of blade 40 shown in FIG. 2. The contour lines in the cross-section identify the traces followed by the machining tool. As FIG. 6 shows, G identifies the length of blade 40, Gbout the blade length from the outermost periphery (tip) of blade 40 to radius R1, and Gbin the blade length from the innermost periphery (base) of blade 40 to radius R1. D identifies the distance from the outermost periphery.

In FIG. 5(*a*), the slope (absolute value) of line L2 is smaller than that of line L1. With line L3, the blade angle α is nearly constant. With line L4, the blade angle α is set to become smaller as the blade base is approached (radius. Rin). By setting the blade angle in this way, the exhaust performance can be optimized in region A1 located outside (Rout≥R≥R1) of radius R1 where the circumferential velocity is relatively large and the exhaust performance can be easily set to be high just as previously done while giving more attention than previous to the suppression of reverse flow of the gas flows in region A2 (R1≥R) where the circumferential velocity is relatively small.

In FIG. 5(*a*), lines L1 through L4 are used wherein the blade angle α changes linearly with radius R. However, it is also acceptable to use a line wherein the blade angle α increases monotonically or decreases monotonically. It is also acceptable to change the blade angle α as identified by line L5 (parabola) in FIG. 5(*b*) where a peak is positioned at radius R1. In this case, if the change in inter-blade distance S is kept constant as done previously, only one machining equation will be required as in the past that relates to blade angle α and inter-blade distance S.

Equations (3) and (4) shown below are the equations that can at once represent situations such as that shown in FIG. 5(*a*) where line L1 is used in region A1 and line L3 or L4 is used in region A2 or the situation where a line such as line L5 shown in FIG. 5(*b*) is used. To explain, blade angle α is set in region A1 to satisfy equation (3) while the blade angle α is set in region A2 to satisfy equation (4). If blade 40 is formed using machining equations that satisfy these conditions, the operation and effects described above are achieved.

$$\alpha\text{out} \le \alpha \le \alpha b \text{ (region } A1) \quad (3)$$

$$\alpha b \ge \alpha \ge \alpha\text{in (region } A2) \quad (4)$$

The rotor 4B shown in FIG. 2 is obtained when blades 40 are machined according to line L4 in FIG. 5(*a*). FIG. 2(*a*) shows a plan view while (*b*) shows a perspective view. In region A1, since both the rotor 4B shown in FIG. 2 and the rotor 400 shown in FIG. 4 are machined using the machining equation characterized by line L1, the blade shape is the same. However, in region A2, because blade angle α of rotor 4B is smaller than that of rotor 400 as identified by line L4, the aperture rate is smaller than that of a conventional rotor 400. As a result, the reverse flow of the gas molecules in the inner side where the circumferential velocity is relatively small can be better suppressed than previously. The overall result is an improvement in exhaust performance. With the first embodiment, the blade angle of the blades of stator 2B shown in FIG. 2 is set to be similar to that of blades 40 of rotor 4B.

With FIG. 5(*a*), the machining equations change only at radius R1. However, so long as the conditions of equations (3) and (4) are met, a plurality of machining equations can be used within region A1 or within region A2. Furthermore, there is not a single value of radius R1 that delineates region A1 from region A2, and the value of radius R1 changes depending on what aspect of exhaust performance is given importance: compression ratio, exhaust rate, or others.

Second Mode

With the afore-described first mode, the trend that defines the change in the blade angle α is made to transition at radius R1 as shown in FIG. 5 so as to suppress the reverse flow of the gas molecules in the inner side (region A2). However, in the case where the blade angle α decreases as in lines L4 or L5 of FIG. 5, if the rate of decrease is too large, a situation can arise where—when looking at blade 40 from the outer side—the gap between the blades in the inner side where the machining tool is to be inserted becomes hidden by the blades on the outer side. If this happens, it becomes impossible to perform the machining from the outer diameter direction, and rotor 4B has to be machined from the axial direction.

However, as FIG. 1 shows, because rotor 4B is located above rotors 4B of the 2nd through the 4th stages, the distance between the upper and lower blades is only slightly greater than the dimensions of one stage worth of a stator. Because of this, it is extremely difficult to machine rotor 4B from the axial direction. Therefore, with the second mode, the shape of the blade is such that, while satisfying the conditions of the first mode, the rotor can be machined from the radial outer side of the rotor. It should be noted that the stators 2B shown in FIG. 3 can be machined from the axial direction more easily than rotor 4B can be since stators 2B can be machined one stage at a time.

(First Blade Shape)

The first blade shape is set so that the inter-blade distance S of blade 40 satisfies equation (5) below. In regards to distance D from the outermost periphery of blade 40 shown in FIG. 6, for the values of Dx and Dy satisfying the relationship Dx<Dy, the inter-blade distance for distance Dx is set to be Sx and the inter-blade distance for distance Dy is set to be Sy. H is the height of blade 40 in the axial direction.

$$\{Sx-(H/\tan \alpha x)\}/2 \ge \{Sy-(H/\tan \alpha y)\}/2 \quad (5)$$

Figure 7:
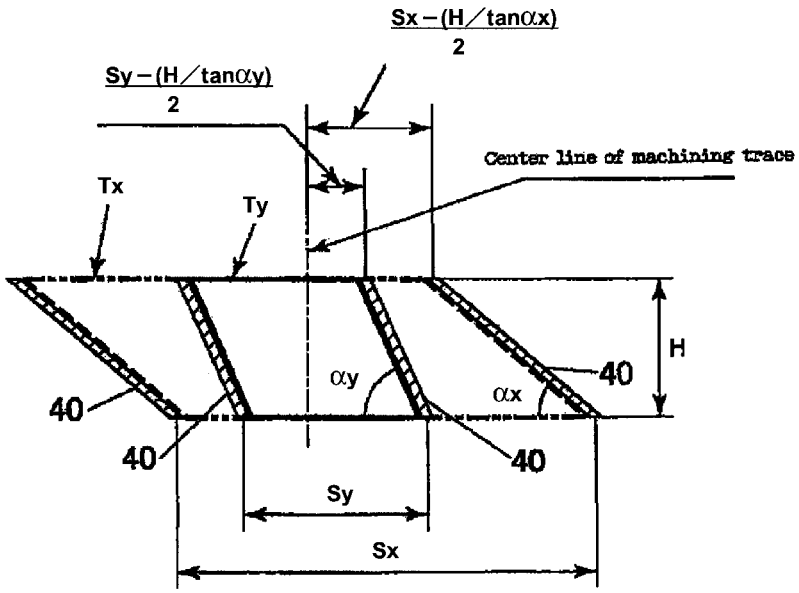
FIG. 7 is a figure describing the traces of a machining tool.

FIG. 7 is a figure that explains equation (5) and shows traces Tx and Ty of a machining tool at distance Dx and Dy as seen from the outer side. Since the blade 40 is machined from the outer side, in FIG. 7, the trace Tx of the tool at the inner side has to stay inside of the trace Ty of the tool on the outer side. Here, by setting the inter-blade distance S as defined by equation (5) with respect to blade angle α, the relationship shown in FIG. 7 is satisfied, and blade 40 can be machined from the outer side. As for blade angle α, it should be set as defined by equations (1) and (2) or equations (3) and (4).

(Second Blade Shape)

The second blade shape is set so that the inter-blade distance S of blade 40 satisfies the following equation (6). With this setting, since the inter-blade distance S decreases at a constant rate from the outer side to the inner side, it is possible to machine blade 40 from the outer side. Equation (6) relates to the inter-blade distance S, and blade angle α should be set as defined by equations (1) and (2) or equations (3) and (4).

$$S = S\text{out} - (S\text{out} - S\text{in}) \cdot (D/G) \quad (6)$$

(Third Blade Shape)

The third blade shape is set so that the inter-blade distance S of blade 40 at distance D satisfies the following equations (7) and (8). Sb is the inter-blade distance at radius R1 and is set to be larger than the inter-blade distance. Sc at the innermost periphery (blade base).

$$(\text{Region } A1):\ S = S\text{out} - (S\text{out} - Sb) \cdot (D/Gb\text{out}) \quad (7)$$

$$(\text{Region } A2):\ S = S\text{out} - (Sb - S\text{in}) \cdot (D - Gb\text{out})/Gb\text{in} \quad (8)$$

As afore-described, with the first mode, the blade angle is set to be optimum in the region that has the dominant effect on exhaust performance, that is, from the outer periphery of the blade to the middle of the blade (region A1) while providing a suppressive effect on reverse flow of the gas molecules to the inner periphery (region A2) of the blade which strongly affects reverse flow, As a result, the exhaust performance of the turbomolecular pump is improved. Furthermore, by setting the inter-blade distance S as in the second embodiment, the machining of the twisted blades is made simple.

What is claimed is:

1. A turbomolecular pump comprising:

a plurality of stages that are arranged alternately with rotors having a plurality of blades radially extending from a rotating body and stators having a plurality of blades radially extending toward the rotating shaft of said rotating body, wherein the blades provided on at least either of said rotor or said stator are formed as twisted blades having a blade angle of said blades set by an equation in which the radius from said rotational shaft is a variable; and the equation of said blade angle comprises a first equation which provides the optimum angle of each blade located outside of a predetermined radius and a second equation which provides the blade angle that suppresses reverse flow of gas molecules inside the predetermined radius wherein the blade angle $\alpha$ in said first equation decreases monotonically toward the outer side to satisfy the condition, $\alpha out \leq \alpha \leq \alpha b$, and the blade angle $\alpha$ in said second equation decreases monotonically or is constant toward the inner side to satisfy the condition, $\alpha b \geq \alpha \geq \alpha in$, where $\alpha b$ is the blade angle at said predetermined radius, $\alpha in$ is the blade angle at the innermost periphery of said blade and $\alpha out$ is the blade angle at the outermost periphery of said blade.

2. The turbomolecular pump according to claim 1 wherein at least either of said equation 1 or equation 2 comprises a plurality of equations.

3. A turbomolecular pump comprising multiple stages of alternately arranged rotors comprising a plurality of blades radially extending from a rotating body and stators comprising a plurality of blades radially extending toward the rotating shaft of said rotating body;

wherein said blade is a twisted blade whose blade angle $\alpha$ decreases monotonically toward the outer side to satisfy the condition "$\alpha out \leq \alpha \leq \alpha b$" at the outside of a predetermined radius and decreases monotonically or is constant toward the inner side to satisfy the condition, $\alpha b \geq \alpha \geq \alpha in$, at the inside of said predetermined radius where $\alpha b$ is the blade angle at said predetermined radius, $\alpha in$ is the blade angle at the innermost periphery of said blade and $\alpha out$ is the blade angle at the outermost periphery of said blade.

4. The turbomolecular pump according to claim 1, wherein the blades of said rotor are formed to satisfy the equation $\{Sx-(H/\tan \alpha x)\}/2 \geq \{Sy-(H/\tan \alpha y)\}/2$ where Sx and $\alpha x$ respectively represent the inter-blade distance and the blade angle of a blade at any distance from the outermost periphery of a blade, Sy and $\alpha y$ respectively represent the inter-blade distance and the blade angle at a distance less than said any distance, and H represents the axial direction height of a blade.

5. The turbomolecular pump according to claim 2, wherein the blades of said rotor are formed to satisfy the equation $\{Sx-(H/\tan \alpha x)\}/2 \geq \{Sy-(H/\tan \alpha y)\}/2$ where Sx and $\alpha x$ respectively represent the inter-blade distance and the blade angle of a blade at any distance from the outermost periphery of a blade, Sy and $\alpha y$ respectively represent the inter-blade distance and the blade angle at a distance less than said any distance, and H represents the axial direction height of a blade.

* * * * *